US006640068B2

(12) United States Patent
Wagner et al.

(10) Patent No.: US 6,640,068 B2
(45) Date of Patent: Oct. 28, 2003

(54) SYSTEM FOR HANDLING LONG PHOTORECEPTOR BELTS

(75) Inventors: Moritz P. Wagner, Walworth, NY (US); Richard Shoemaker, Milford, CT (US)

(73) Assignee: Xerox Corporation, Stamford, CT (US)

( * ) Notice: Subject to any disclaimer, the term of this patent is extended or adjusted under 35 U.S.C. 154(b) by 87 days.

(21) Appl. No.: 10/038,144

(22) Filed: Nov. 9, 2001

(65) Prior Publication Data

US 2003/0091367 A1 May 15, 2003

(51) Int. Cl.[7] ..... G03G 15/02
(52) U.S. Cl. ..... 399/116
(58) Field of Search ..... 399/116, 162, 399/164; 206/303, 455, 493

(56) References Cited

U.S. PATENT DOCUMENTS 3,888,577 A * 6/1975 Meyer ..... 399/116
4,655,578 A * 4/1987 Kurtz et al. ..... 399/114
4,811,839 A * 3/1989 Cornell et al. ..... 206/303
5,417,322 A * 5/1995 Jeran et al. ..... 206/303
5,708,924 A * 1/1998 Shogren et al. ..... 399/116
6,014,535 A * 1/2000 Zenk et al. ..... 399/116
6,049,682 A * 4/2000 Goetzke et al. ..... 399/116
6,097,912 A * 8/2000 Watson et al. ..... 399/116
6,175,704 B1 * 1/2001 Yamamoto ..... 399/116
6,459,871 B2 * 10/2002 Kwak et al. ..... 399/116

* cited by examiner

*Primary Examiner*—Robert Beatty
(74) *Attorney, Agent, or Firm*—Perman & Green, LLP

(57) ABSTRACT

A system for handling of a photoreceptor belt by distributing pressure points on the belt over a large area such that physical damage to the photoreceptor belt during handling thereof is minimized. The system includes a photoreceptor belt and a handling belt. The outer surface of the handling belt is positioned under and in contiguous relation to the inside surface of the photoreceptor belt. An edge of the handling belt includes at least one tab member projecting therefrom. Also there is a taper projecting along the edge extending inwardly, the tab member and the taper adapted to assist the handling belt to be positioned within the photoreceptor belt.

12 Claims, 2 Drawing Sheets

SYSTEM FOR HANDLING LONG PHOTORECEPTOR BELTS

BACKGROUND OF THE INVENTION

1. Field of the Invention

The present invention relates to xerographic printing machine technology and more particularly, the invention relates to a simple, fast and easy procedure for handling a photoreceptor belt as typically used in a xerographic apparatus so as to substantially prevent any damage to the belt during handling.

A large belt type photoreceptor as used in xerographic copying machines is very flexible and unwieldy for one person to handle without causing some damage to the belt during handling and thereby incurring resulting copy quality defects. The belt drive system in machines using a large belt is constructed with multiple components whose edges present obstacles to simply and easily sliding of a belt onto the belt drive and support system. The edges of an AMAT belt, for example, tend to curl inward causing the edges to catch on the machine hardware, thereby creating a kink in the imaging area of the photoreceptor. The embodiments described herein provide a procedure for evenly distributing the load evenly over a large area when holding a photoreceptor belt. The embodiments described herein can be used, for example, in manufacturing when a xerographic machine is initially outfitted with a photoreceptor, and can also be used in the field by technical representative who are in the process of replacing photoreceptor belts in xerographic machines. Also, the invention can be used in belt finishing areas of a manufacturing process for photoreceptor belts where inspections occur before packaging, or wherever a belt needs to be handled.

2. Brief Description of Related Developments

Electrophotographic printing is a well known method of copying or printing documents by exposing a substantially uniformly charged photoreceptor to an optical light image of an original document, discharging the photoreceptor to create an electrostatic latent image of the original document on the photoreceptor's surface, selectively adhering toner to the latent image, and transferring the resulting toner pattern from the photoreceptor, either directly to a marking substrate such as a sheet of paper, or indirectly to a marking substrate after an intermediate transfer step. The transferred toner powder image is subsequently fused to the marking substrate using heat and/or pressure to make the image permanent. Finally, the surface of the photoreceptor is cleaned of residual materials and recharged in preparation for the creation of another image.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for the production of different colored images and their respective complimentarily colored toner. Each single color toner image is transferred to the copy sheet in superimposed registration with the prior toner image.

This creates a multi-layered toner image on the copy sheet. Thereafter, the multi-layered toner image is permanently affixed to the copy sheet creating a color copy. The developer material may be a liquid or a powder material.

In the xerographic type processes described above the photoreceptor can be in the form of a belt that is both driven and positioned within the electrophotographic apparatus by a drive system (and corresponding supporting structure) which drives and supports the photoconductor belt in the xerographic apparatus.

By providing the above drive system and support member, the photoconductive belt is driven and positioned at a predetermined location relative to the associated light source during exposure thereof. Moreover, the above drive frame and support member smoothes out the photoconductive belt as such belt is advanced through the imaging zone. As a result, the frame and support member provides for registration of the photoconductive member within the machine thereby reducing magnification and focus errors.

The drive frame and support member is positioned substantially adjacent to the photoconductor in the imaging zone during normal operation of the machine. When it is desired to replace the photoconductor, due to wear or damage, the drive frame and support member may be temporarily positioned away from the photoconductive belt to assist in removal of the old photoconductor from the machine. After installation of a new photoreceptor it is necessary to reposition the drive frame and support member back to a location substantially adjacent the photoconductor.

One problem which may occur during the above described procedure is failure of the person who is performing the photoconductor belt replacement (normally a service technician), to avoid damaging and forming kinks in the relatively delicate edges of the photoreceptor belt when the belt is mounted on the frame and support structure upon which the belt is driven and supported within the electrophotographic apparatus. It is desirable to minimize physical damage to the photoreceptor belt during handling of the belt; minimize the costly replacement of the photoreceptor belt; minimize possible printing or copy defects due to damage of the belt; and minimize adding to the overall aggregate service cost associated with maintenance of the electrophotographic printing apparatus.

U.S. Pat. No. 5,204,717 describes a bracket within an electrophotographic apparatus that is adapted to pivot so as to facilitate removal of a photoconductive belt.

Accordingly, it is a primary advantage of the embodiments described herein to provide a system which prevents damage to a belt photoreceptor while it is being handled. Other advantages include providing a means to make it simpler to mount and position a photoconductive belt within an electrophotographic apparatus such that during the process of handling the belt any damage to the belt will be avoided, thereby avoiding poor copy quality due to a damaged photoconductor; and minimizing adding to the aggregate service cost associated with maintenance of an electrophotographic printing apparatus particularly with regard to the replacement of a photoconductive belt. Additional advantages of the invention will be set forth in part in the description which follows and in addition will be obvious from the description, or may be learned by practice of the invention in accordance with the various features and combinations as particularly pointed out in the appended claims.

SUMMARY OF THE INVENTION

To achieve the advantages described herein the inventive features as embodied by the present invention include a system for handling of a photoreceptor belt by distributing pressure points on the belt over a large area such that physical damage to the belt during handling is minimized.

The system comprises a photoreceptor belt and a handling belt. The handling belt includes outer surface that is positioned under and in contiguous relation to the inside surface of the photoreceptor belt. An edge of the handling belt includes at least one tab member projecting therefrom, and a taper projecting from the edge of the handling belt inwardly. The tab member and the taper are adapted to assist the handling belt to be positioned within the photoreceptor belt.

BRIEF DESCRIPTION OF THE DRAWINGS

The accompanying drawings, which are incorporated in and constitute a part of the specification illustrate one embodiment of the invention and, together with the description, serve to explain the principles of the invention.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

For a general understanding of the features of the present invention, reference is made to the drawings. The following description illustrates the path that a belt photoreceptor follows in an electrophotographic machine, and therefore presents a good indication of the various issues that could be presented if the photoreceptor is damaged during handling.

It will also become evident from the following discussion that the present invention is equally well suited for use in a wide variety of printing systems, and is not necessarily limited in its application to the particular xerographic printing system illustrated and described herein as an example.

Figure 1:
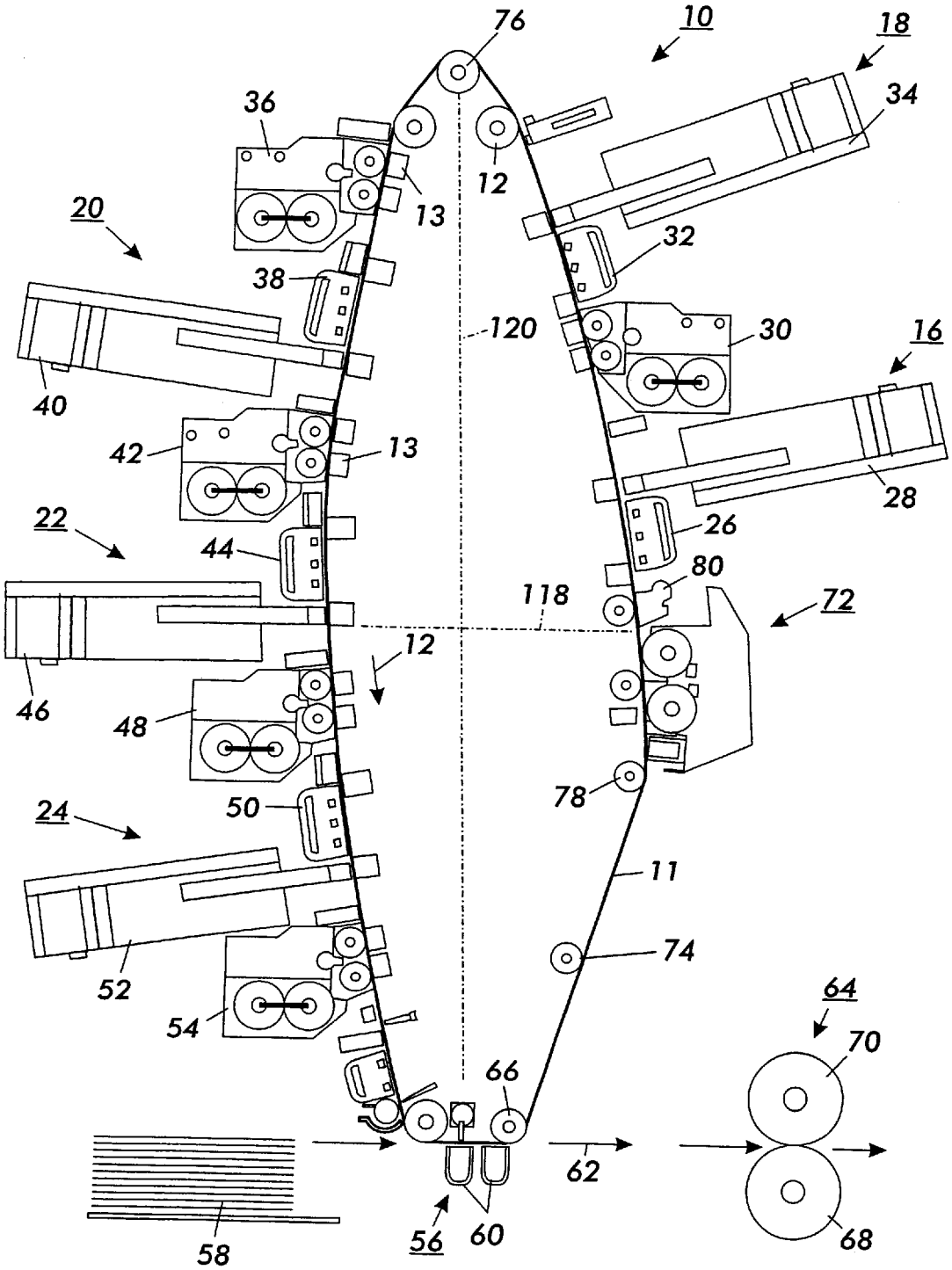
FIG. 1 is a partial schematic view of an electrophotographic printing apparatus that can be employed using the features of the present invention.

With reference to FIG. 1, there is shown a single pass multi-color printing machine 10. This printing machine employs a photoconductive belt 11, supported by a plurality of rollers or bars, 13. Photoconductive belt 11 is arranged in a vertical orientation. Belt 11 advances in the direction of arrow 12 to move successive portions of the external surface of photoconductive belt 11 sequentially beneath the various processing stations disposed about the path of movement thereof. The photoconductive belt has a major axis 120 and a minor axis 118. The major and minor axes are perpendicular to one another. Photoconductive belt 11 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, belt 11 passes through image recording station 16. Image recording station 16 includes a charging device and an exposure device. The charging device includes a corona generator 26 that charges the exterior surface of photoconductive belt 11 to a relatively high, substantially uniform potential. After the exterior surface of photoconductive belt 11 is charged, the charged portion thereof advances to the exposure device. The exposure device includes a raster output scanner (ROS) 28, which illuminates the charged portion of the exterior surface of photoconductive belt 11 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 11, belt 11 continues to advance in the direction of arrow 14 to image recording station 18.

Image recording station 18 includes a recharging device and an exposure device. The charging device includes a corona generator 32 which recharges the exterior surface of photoconductive belt 11 to a relatively high, substantially uniform potential. The exposure device includes a ROS 34 which illuminates the charged portion of the exterior surface of photoconductive belt 11 selectively to record a second electrostatic latent image thereon. This second electrostatic latent image corresponds to the regions to be developed with magenta toner particles (a second selected color). This second electrostatic latent image is now advanced to the next successive developer unit 36.

Developer unit 36 deposits the magenta toner particles on the electrostatic latent image. In this way, a magenta toner powder image is formed on the exterior surface of photoconductive belt 11. After the magenta toner powder image has been developed on the exterior surface of photoconductive belt 11, photoconductive belt 11 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 11 to selectively dissipate the charge thereon to record a third electrostatic latent image corresponding to the regions to be developed with yellow toner particles (a third selected color). This third electrostatic latent image is now advanced to the next successive developer unit 42.

Developer unit 42 deposits yellow toner particles on the exterior surface of photoconductive belt 11 to form a yellow toner powder image thereon. After the third electrostatic latent image has been developed with yellow toner, belt 11 advances in the direction of arrow 14 to the next image recording station 22.

Image recording station 22 includes a charging device and an exposure device. The charging device includes a corona generator 44, which charges the exterior surface of photoconductive belt 11 to a relatively high, substantially uniform potential. The exposure device includes ROS 46, which illuminates the charged portion of the exterior surface of photoconductive belt 11 to record a fourth electrostatic latent image for development with cyan toner particles (a fourth selected color). After the fourth electrostatic latent image is recorded on the exterior surface of photoconductive belt 11, photoconductive belt 11 advances this electrostatic latent image to the cyan developer unit 48.

Cyan developer unit 48 deposits cyan toner particles on the fourth electrostatic latent image. These toner particles may be partially in superimposed registration with the previously formed yellow powder image. After the cyan toner powder image is formed on the exterior surface of photoconductive belt 11, photoconductive belt 11 advances to the next image recording station 24.

Image recording station 24 includes a charging device and an exposure device. The charging device includes a corona generator 50 which charges the exterior surface of photoconductive belt 11 to a relatively high, substantially uniform potential. The exposure device includes ROS 54, which illuminates the charged portion of the exterior surfaces of photoconductive belt 11 to selectively discharge those portions of the charged exterior surface of photoconductive belt 11 which are to be developed with black toner particles. The fifth electrostatic latent image, to be developed with black toner particles, is advanced to black developer unit 54.

At black developer unit 54, black toner particles are deposited on the exterior surface of photoconductive belt 11. These black toner particles form a black toner powder image which may be partially or totally in superimposed registration with the previously formed yellow, magenta and cyan toner powder images. In this way, a multi-color toner powder image is formed on the exterior surface of photoconductive belt 11. Thereafter, photoconductive belt 11 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the back side of the paper. This attracts the developed multi-color toner image from the exterior surface of photoconductive belt 11 to the sheet of paper. Stripping axis roller 66 contacts the interior surface of photoconductive belt 11 and provides thereto a sufficiently sharp bend. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 11. The photoconductive belt 11 moves over isolation roller 78 which isolates the cleaning operation at cleaning station 72. At cleaning station 72, the residual toner particles are removed from photoconductive belt 11. The belt 11 then moves under spots blade 80 to also remove toner particles therefrom.

Figure 2:
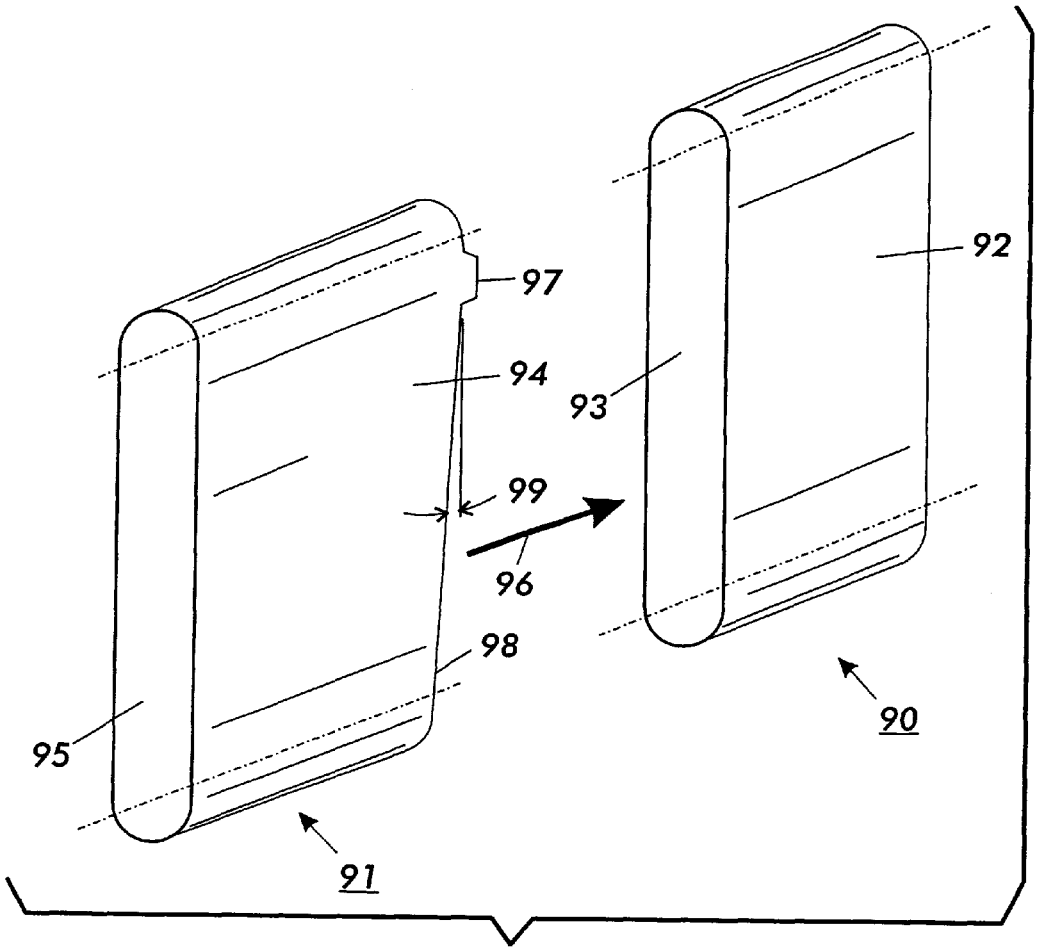
FIG. 2 is a schematic view illustrating the positioning of a handling belt within a photoreceptor belt.

Turning now to the primary features of the present invention and FIG. 2, there is shown in accordance with the embodiments described herein a system that will ease the overall handling of a photoreceptor belt, or specifically an AMAT type photoreceptor belt, in such a manner so as to substantially minimize physical damage to the belt as it is being handled.

The main issue that must be dealt with in the handling of long belt photoreceptors (longer than five (5) to six (6) feet in circumference, e.g. when longer than five (5) feet) there is the high likelihood of the belt photoreceptor being damaged while it is being handled. Just holding or supporting the highly flexible belt photoreceptor can lead to a crease or "ding" in the photoreceptor with a resulting defect in subsequent prints that are made in a xerographic copier that employs the damaged belt photoreceptor.

In order to minimize acute flexure and creasing on the surface of a belt photoreceptor during handling or holding a photoreceptor belt 90, a handling belt 91 as illustrated in FIG. 2 is used inside the photoreceptor belt 90. The photoreceptor belt 90 includes an outer surface 92 and an inside surface 93. The handling belt 91 also includes an outer surface 94 and an inside surface 95. As illustrated in FIG. 2, handling belt 91 is inserted in the direction of arrow 96 within photoreceptor belt 90 so that outer surface 94 of handling belt 91 lies in contiguous contact with inner surface 93 of photoreceptor belt 90. Once handling belt 91 is inserted within photoreceptor belt 90, photoreceptor belt can be handled in a normal fashion, and substantially avoiding damage typically incurred by handling a photoreceptor belt by itself.

Figure 3:
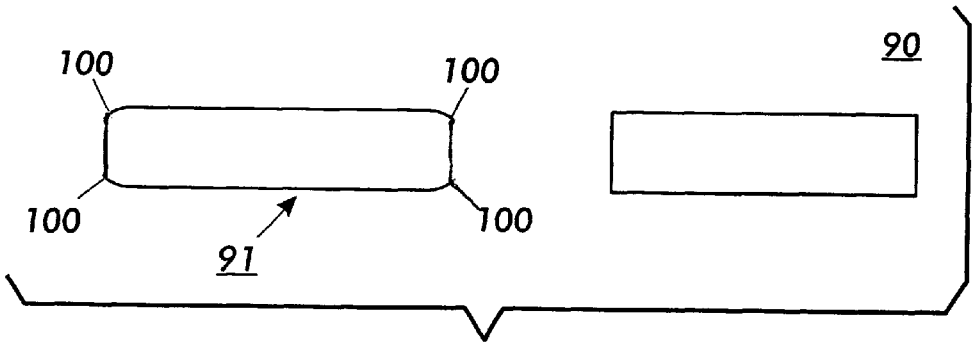
FIG. 3 is a top cross sectional view of both a handling belt and a photoreceptor belt in accordance with the features of the invention described herein.

In order to further assist in the handling of photoreceptor belt 90 and permit handling belt 91 to be easily positioned within photoreceptor belt 90, there are various means that can be used to accomplish this result. Handling belt 91 can be structured in different ways to assist handling belt 91 so as to be positioned within photoreceptor belt 90 more easily. For example, two ways that this can be accomplished include (i) by providing a tab element 97 extending from handling belt 91 along edge 98, and/or (ii) by providing a taper 99 going in an inward direction along edge 98 of handling belt 91. If a tab element is used, the tab element 97 projects from edge 98 of the handling belt in such a manner so as to help belt 91 be positioned under photoreceptor belt 90. If a taper is used, the handling belt 91 is slightly tapered (about one (1) to ten (10) degrees) along edge 98. A third means to allow the handling belt 91 to be more easily positioned within photoreceptor belt 91 is illustrated in FIG. 3. By providing an inward curl 100 to each of the edges of handling belt 91 as shown in FIG. 3, the insertion of handling belt 91 into photoreceptor belt 90 is made easier. FIG. 3 also illustrates photoreceptor belt 90 having regular edges, i.e. no inward curl.

The present invention proposes the use of a handling belt located within a photoreceptor belt for the general handling of the belt. For example, in the installation of the belt of the photoreceptor belt in, for example, a xerographic machine in a manufacturing or customer location. The handling belt is preferably made of a "thicker" material than the photoreceptor belt so that localized pressure points induced during handling and installation would be minimized. Tab members 97 are used as points to grip belt 91 for easy removal of belt 91 without touching the photoreceptor belt surface.

Handling belt 91 is formed of a material having preferably a thickness at least double the thickness of photoreceptor belt 90. For example, photoreceptor belt 90 can range in thickness from about five (5) to about seven (7) thousands of an inch, whereas handling belt 91 can range in thickness from about ten (10) to about fifteen (15) thousands of an inch. Also, the width of the handling belt 91 is preferably greater than the width of the photoreceptor belt. For example, handling belt 91 can be about one (1) inch wider along each edge thereof, i.e., about two (2) inches wider than photoreceptor belt 90. There are various materials that handling belt 91 can be made of. Some of the preferred materials include a high density polyethylene material (HDPE), a vinyl material or a polycarbonate base material. Any of these materials can be given anti-static properties by, for example, placing a coating of an anti-static material on one of the base materials or by dispersing an anti-static material within one of the base materials, e.g., a conductive material such as a carbon filler can be dispersed within a polycarbonate base material. Both the material selection and the general surface texture of the handling belt 91 are important so that the handling belt can easily be removed upon installation of the photoreceptor belt. The handling belt should be strong enough to distribute pressure points on the photoreceptor belt but pliable enough to conform to the photoreceptor module. The surface of the handling belt should be slippery so that the photoreceptor belt can easily slide off the handling belt. This can be achieved by having an optimized surface texture on the handling belt.

While this invention has been described in conjunction with a specific embodiment thereof, it should be evident that many alternatives and modifications can be devised by those skilled in the art without departing from the invention. Accordingly, the present invention is intended to embrace all such alternatives, modifications and variances which fall within the scope of the appended claims.

What is claimed is:

1. A system for handling of a photoreceptor belt by distributing pressure points on the belt over a large area such that physical damage to the belt during handling is minimized comprising a photoreceptor belt and a handling belt, the outer surface of the handling belt being positioned under and in contiguous relation to the inside surface of the photoreceptor belt, the handling belt provided with a taper from top to bottom from an edge of said handling belt to assist the handling belt to be positioned within the photoreceptor belt, the taper being positioned on an edge of the handling belt which is first inserted within the photoreceptor belt.

2. A system according to claim 1 wherein said handling belt includes at least one tab member projecting from said edge.

3. A system according to claim 1 wherein said taper is from about 1° to about 10°.

4. A system according to claim 1 wherein the thickness of the handling belt is at least double the thickness of the photoreceptor belt.

5. A system according to claim 4 wherein the width of the handling belt is greater than the width of the photoreceptor belt.

6. A system according to claim 5 wherein the handling belt is at least one inch wider than the photoreceptor belt along each edge thereof.

7. A system according to claim 1 wherein the handling belt is formed of a material selected from the group consisting of a vinyl material, a high density polyethylene and a polycarbonate based material.

8. A system according to claim 7 wherein said handling belt material includes an anti-static material.

9. A system according to claim 1 wherein the texture of the surface of said handling belt that is in contact with said photoreceptor is sufficiently smooth whereby said photoreceptor belt is adapted to slide off said handling belt.

10. A system according to claim 9 wherein said surface of said handling belt is a textured surface.

11. A system according to claim 1 wherein the circumference of said photoreceptor belt is greater than five feet.

12. A system for handling of a photoreceptor belt by distributing pressure points on the belt over a large area such that physical damage to the belt during handling is minimized comprising a photoreceptor belt and a handling belt, the outer surface of the handling belt being positioned under and in contiguous relation to the inside surface of the photoreceptor belt, the handling belt provided with an inward curl at each edge of said handling belt to assist the handling belt to be positioned within the photoreceptor belt.

* * * * *